United States Patent [19]

Goldman

[11] Patent Number: 4,794,671

[45] Date of Patent: Jan. 3, 1989

[54] METHOD OF OPENING BALES OF COTTON AND OTHER FIBERS

[76] Inventor: Giora Goldman, 15 Hakibuzzim Street, Kiriat Haiim, Israel

[21] Appl. No.: 95,563

[22] Filed: Sep. 10, 1987

[30] Foreign Application Priority Data

Sep. 14, 1986 [IL] Israel ..... 80024

[51] Int. Cl.[4] ..... D01B 3/04; D01G 7/04

[52] U.S. Cl. ..... 19/65 R; 19/80 R; 100/299

[58] Field of Search ..... 19/65 A, 65 R, 80 R, 19/80 A, 81; 100/8, 14, 299

[56] References Cited

U.S. PATENT DOCUMENTS

| | | | |
|---|---|---|---|
| 433,642 | 8/1890 | Bourne | 19/80 R |
| 3,820,197 | 6/1974 | Jeanmaire | 19/80 R |
| 4,100,651 | 7/1978 | Wornall | 18/81 X |

*Primary Examiner*—Louis K. Rimrodt

*Attorney, Agent, or Firm*—Frishauf, Holtz, Goodman & Woodward

[57] ABSTRACT

The method and equipment for removing the straps tied around a bale of cotton comprises the steps of: 1. lifting and transporting the bale by a forklift to an impact cutter provided with a long horizontal cutter blade, 2. pushing the bale towards the cutter blade, whereby the impact cutter is operated by contact of the bale with an electric switch, and the straps are cut in one place each by the rapid motion of the cutter blade, 3. lifting the bale by means of the forklift until the free ends of the straps flap over the lower of two rollers of a strap-pulling device and lowering the upper of the two rollers into contact with the straps and the lower roller, 4. switching on the motor of the strap-pulling device, whereby the rotating rollers pull the straps off the bale, and 5. carrying the bale to its destination.

17 Claims, 2 Drawing Sheets

METHOD OF OPENING BALES OF COTTON AND OTHER FIBERS

BACKGROUND OF THE INVENTION

The invention relates to a method of removing the ties or straps surrounding and holding a bale of cotton, hay or other fibers; it further relates to equipment for (1) transporting and holding a bale in position, (2) simultaneously cutting all straps by means of an impact cutter, and (3) pulling the straps off the bale without mussing it up.

Cotton wool is usually baled in the field and steel straps are tied around its circumference in order to keep the bale in its shape. The ready bales are usually transported into storage, and from there to factories for spinning and further processing. Before processing the bales have to be opened by removing the straps, and this operation has, up to now, been done by hand, including cutting the straps by hand and unwinding them from the bale, while pulling them from under the heavy bale by hand. This unpacking requires several people and is, accordingly, expensive.

It is, therefore, the object of the present invention to provide equipment for cutting and removing the steel straps around a cottom bale by mechanical means only, thus requiring practically no manual effort.

It is another object to utilize, as far as possible, known equipment, so modified as to perfectly suit the required task.

And it is a final object to provide simple and uncomplicated equipment which should work uninterruptedly without major maintenance expenses.

SUMMARY OF THE INVENTION

The method of opening a bale of cotton or other fibers according to the invention comprises the following steps:

(1) Lifting the cotton bale by means of a mechanical lifting and transporting equipment; holding it in position by pressing down on its top surface, while supporting its bottom surface;

(2) transporting the bale to an impact cutting device provided with a sharp, preferably horizontal cutter blade of a length greater than the distance between the two outermost straps holding the bale;

(3) approaching the bale with the straps opposite the cutter blade and actuating the impact cutting device, so as to cut all straps in one operation;

(4) moving the bale with the aid of said lifting and transporting equipment in a manner effecting the free upper ends of the cut straps to engage with a strap-pulling device in the form of a pair of contacting elastic rollers, causing the pair of rollers to close upon the straps and to be rotated in opposite senses of direction, so as to pull the straps off around the bale by friction and to dispose of the straps; and (5) carrying the bale, after it has been freed of its straps, to its destination.

As an alternative, the straps or ties are gripped between the two contacting rollers and the lifting equipment is moved backwards away from the rollers, thereby pulling the straps off the bale.

In a preferred embodiment of the method the rear of the bale opposite the side to be cut, is supported by a vertical plate, in order to take up the shock of the cutter blade and to prevent disarrangement of the bale's shape.

Preferred equipment used for carrying out the abovedescribed method is in the shape of a lift truck provided with upper and lower fork arms which are independently movable in upward and downward directions, where of the lower forks serve to lift the bale off the ground and to support, it while the upper forks serve to hold it in position and in proper shape by pressing onto its top surface.

A horizontal beam is attached to the upper fork arms, the beam being provided with downwardly extending lugs adapted to press onto the bale in the locations between the straps, in order to permit the unhindered movement of the straps while they are pulled away from around the bale, taking into account different spacing of straps on various kinds of bales.

The cutter blade is attached to one, or preferably two, impact cutting devices, which may be either spring-operated or hydraulic-pneumatic of the kind disclosed in my U.S. patent application Ser. No. 043,361, filed Apr. 28, 1987.

The blade is preferably positioned in horizontal alignment, but since modern fork trucks are designed for rotating the load about a horizontal axis, the blade may, in certain cases, be vertically positioned so as to cut through all the horizontally aligned straps of the bale in one blow.

The impact device is energized by hand or by a switching device which is automatically actuated by contact with the cotton bale.

The strap-pulling device consists of two cylindrical rollers covered by an elastic material, rotated in opposite sense of direction by an electric or pneumatic gear-motor unit, whereby the lower roller is stationary in bearings, while the upper roller is pivotally fastened, to permit its upwards or sideways swivelling for automatic postioning of the cut straps between the two rollers.

In a preferred embodiment only the stationary roller is rotated by a gear-motor, while the other roller is rotated by friction with the surface of the stationary roller. As an alternative the upper roller may be positioned in stationary bearings, while the lower roller may be adapted to be swung down so as to provide space for the strap ends to be brought into position below the upper roller. The lower roller will then be swung up into contact with the straps and with the upper roller, whereupon the upper roller is rotationally moved, so as to effect pulling the straps off the bale.

SHORT DESCRIPTION OF THE DRAWINGS

FIG. 1 is a side view, partially broken away of equipment serving to cut the straps of a cotton bale and to remove these straps from the bale, FIG. 2 is a plan view of the equipment illustrated in FIG. 1, FIG. 3 is a front view of a pair of strap-removing rollers, in opened state, and FIG. 4 is a view of the horizontal beam serving to press onto the top of a bale, as viewed from the section line A—A.

DETAILED DESCRIPTION OF THE DRAWINGS

Figure 1:
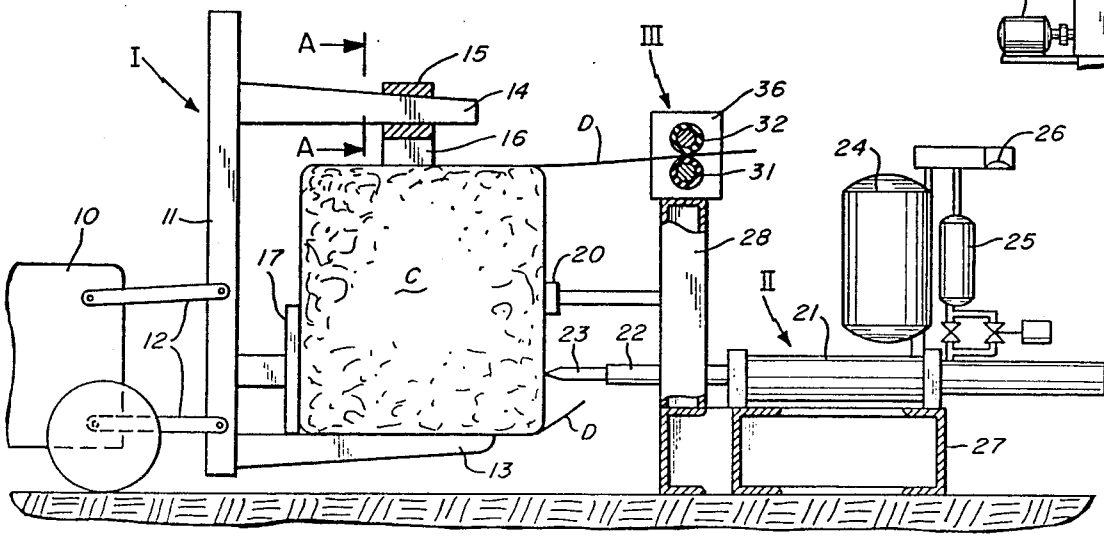
Figure 2:
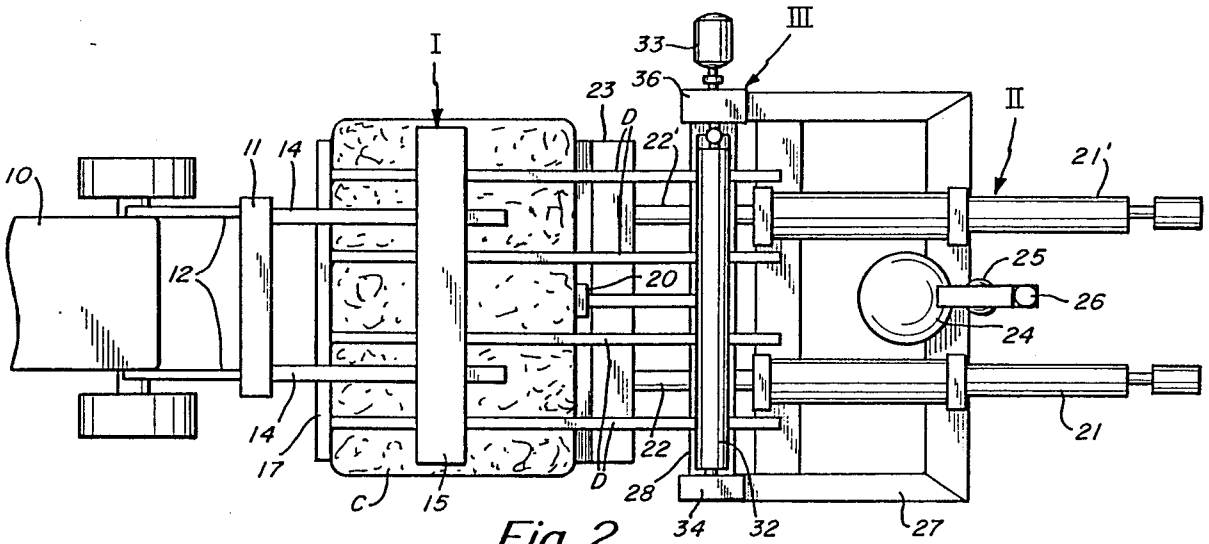

With reference to FIGS. 1 and 2 of the drawings, equipment for unstrapping a bale of cotton C by simultaneously cutting the steel straps D (four straps being shown in the drawing), which surround and tie the bale, consists of three pieces of machinery, viz:

(1) a vehicle I e.g. a fork truck, adapted to firmly hold and transport the bale C;

(2) a stationary strap-cutting device II, in the form of a horizontal blade attached to two impact implements; and (3) a strap-removing implement III firmly attached to the strap-cutting device.

Figure 4:
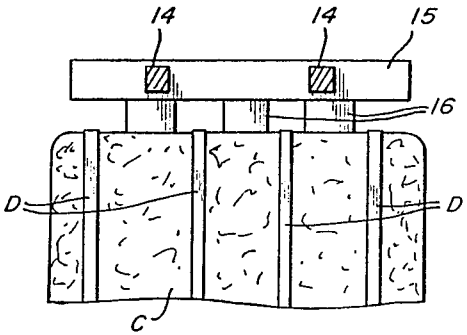

The vehicle I comprises a fork truck body 10 (shown schematically with its body broken off) to which a vertical boom 11 is attached by means of a three-point hitch 12 permitting raising and lowering the boom in accordance with requirements. A pair of lower fork arms 13 is rigidly connected to the lower end of the boom, while a pair of upper fork arms 14 is movably fastened to the boom permitting its forceful upward and downward motion. A horizontal beam 15 is firmly connected to the underside of the two upper fork arms (v. also FIG. 4) which can be pressed down onto the upper surface of the bale by downward movement of these arms. The underside of the beam is provided with downwardly extending lugs 16, their position corresponding to the position of the areas on the cotton bale not covered by the straps D, the recesses between the lugs permitting smooth passage of the straps D while they are pulled off the bale.

A vertical back plate 17 is attached to the boom 11 and serves to support the rear surface of the bale, while the straps are cut by the impact cutter on the opposite, frontal surface.

The bale is carried by the fork truck I to a position opposite the strap-cutting device II where it actuates a switching device 20, which may be in the form of a limit switch or of a proximity sensor. This switching device puts into action two impact cutting cylinders 21 and 21' which carry at the ends of their piston rods 22 and 22' a horizontal, sharp cutting blade 23. In the drawing the impact cutters are of the kind described in my Israeli Patent Specification No. 78698, but it will be understood that any other kind of impact implement may be employed for this purpose, such as spring-actuated impact cutters, as known to the art.

The drawing also shows the auxiliary components of the impact cylinders 21 and 21', such as a common air vessel 24, a pressure vessel 25 and a spool valve 26. Connecting lines are not shown, as they would obscure the drawing. The impact cutting device is mounted on a rigid steel base 27 which is well anchored to the ground, for obvious reasons.

Figure 3:
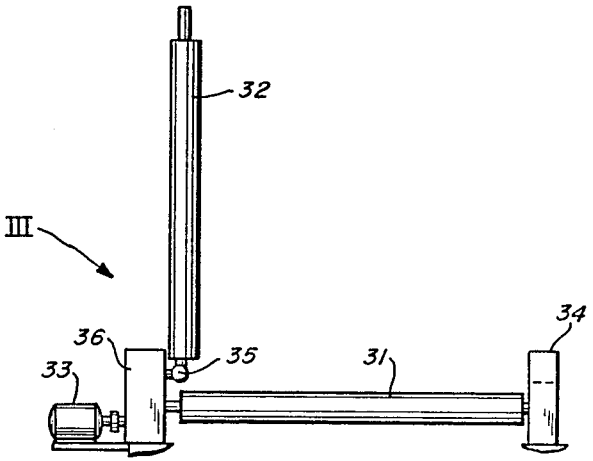

A support 28 in the shape of an inverted "U" is attached to the front portion of the base 27 and carries a strap-pulling device III. It comprises a lower roller 31 which is rotatably attached at its one end to a lower output shaft of a motor-driven (33) gear means 36 and is supported at its other end by a bearing means 34 (v. FIG. 3). It further comprises an upper roller 32 which is likewise rotated by an upper output shaft of the gear means 36, in opposite sense of direction to that of roller 31, through a universal joint 35, about which it can be tilted and raised from contact with the lower roller 31. Its free end is in the form of an axle which is engageable with an upper bearing in the bearing means 34, whenever brought into contact with the lower roller 31. Both rollers have an elastic surface, as e.g. by a rubber covering over a cylindrical metal surface, in order to permit their firm gripping of the straps and their pulling off the bale.

Engagement of the upper loose ends of the straps D after cutting is effected by raising the upper roller 32 into vertical position, lifting the bale by means of the fork truck to a height effecting the strap ends to flap over the lower roller, then lowering and locking the upper roller and actuating the motor 33. The friction of the rollers pulls the straps off the bale, and after having passed between the rollers entirely, the straps are usually dropped into a container for subsequent removal.

It is realized that the aforedescribed equipment represents only one example of all kinds of equipment suitable for carrying the method into effect and that each component thereof may be modified or replaced by other components, within the scope of the appended Claims.

The transport and lifting vehicle may be a fork lift, or a tractor having a vertical boom and fork arms attached to its lifting mechanism.

As an alternative the vehicle may be of the kind of fork truck having both upper and lower fork arms movable in upward and downward directions along a vertical boom which is firmly attached to the vehicle body. In certain fork trucks this boom is additionally swingable about a horizontal axis with the object of turning the load into any position.

As said before, the impact cutter may be of any known design, as long as it will serve to sever the steel straps, ties or wires by one rapid and heavy blow of the cutter blade. Similarly, only one spring-operated or hydraulic-pneumatic impact device may be used for operating the cutter blade.

The strap-pulling rollers are not nececssarily positioned one above the other, but may be positioned in an inclined plane, provided the upper roller is adapted to be urged onto the lower roller, thereby clamping the straps therebetween and pulling them off the bale during their rotation.

The strap-pulling device is shown in the drawing as having both rollers mechanically rotated, but in a simplified embodiment only one of the rollers - either the upper or the lower - may be attached to a motor unit, while the other roller, which can be swung either up or down, is rotated by contact with the elastic surface of the rotating roller, thus pulling the straps off the bale.

Instead of swinging the second roller about a pivot or a universal joint, it may be removed from contact with the first, rotatable roller by other means as known to the art, in order to permit the straps to be eventually fastened between the two rollers.

I claim:

1. A method of removing the straps or ties from a bale of cotton, hay or other fibers, comprising the steps of:

lifting said bale by means of a mechanical lifting and transporting equipment and holding it in position on said equipment by pressing down on its top surface;

transporting said bale to an impact cutting device provided with a cutter blade of a length greater than the distance between the outermost straps holding said bale;

approaching said bale with said straps opposite said impact cutter blade, to effect cutting of all said straps by one blow;

moving said bale by means of said lifting equipment in a manner effecting the free upper ends of the cut straps to engage with a device located above said impact cutting device and adapted to pull said straps off said bale;

causing said strap pulling device to engage said straps so as to effect their being pulled off said bale; and carrying said bale, freed of said straps, to a destination by means of said transporting equipment.

2. The method of claim 1, comprising supporting the rear side of said bale opposite the side facing said cutter blade.

3. A method of removing the straps, ties or wires from a bale of cotton, bay or other fibers, comprising the steps of:

lifting said bale by means of a mechanical lifting and transporting equipment and holding it in position on said equipment by pressing down on its top surface;

transporting said bale to an impact cutting device provided with a cutter blade of a length greater than the distance between the outermost straps holding said bale;

approaching said bale with said straps opposite said impact cutter blade, to effect cutting of all said straps by one blow;

moving said bale by means of said lifting equipment in a manner effecting the free upper ends of the cut straps to engage with a device located above said impact cutting device and adapted to pull said straps off said bale;

causing said strap pulling device to engage and firmly hold said straps;

moving said bale slowly away from said strap-pulling device, so as to effect pulling of said straps off said bale; and carrying said bale, freed of said straps, to a destination by means of said transporting equipment.

4. The method of claim 3, comprising supporting the rear side of said bale opposite the side facing said cutter blade.

5. Equipment for removing straps or ties from a bale of cotton, hay or other fibers, comprising:

impact cutting means for cutting said straps, said impact cutting means including a horizontally positioned cutter blade of a length greater than the distance between outermost ones of said straps holding said bale;

mechanical lifting and transporting means for lifting said bale with said said straps in vertical alignment, said mechanical lifting and transporting means including means for pressing down on a top surface of said bale to hold said bale in a set position on said mechancial lifting and transporting means; and strap removing means located above said cutter blade for engaging free upper ends of said cut straps and for causing said straps to be pulled off said bale.

6. Equipment according to claim 5, wherein said means for pressing down includes a horizontal beam provided with downwardly extending lugs at positions between the straps.

7. Equipment according to claim 5, wherein said mechanical lifting and transporting means includes a fork lift truck having a vertical boom movable in the vertical direction.

8. Equipment according to claim 7, wherein said fork lift truck includes a pair of lower fork arms firmly connected to a bottom portion of said vertical boom, and a pair of upper fork arms movably connected to said vertical boom.

9. Equipment according to claim 8, wherein said fork lift truck includes vertical support plate means attached to a lower portion of said vertical boom for supporting said bale against shock and distortion due to impacts from said cutter blade.

10. Equipment according to claim 5, wherein said impact cutting means includes two pneumatic-hydraulic impact cylinders positioned in parallel, horizontal, spaced-apart alignment, each cylinder having an axis and a piston rod slidably received therein, with each piston rod having a free end, and said horizontally positioned cutter blade is attached to the free ends of said piston rods substantially perpendicular to the axes of said cylinders.

11. Equipment according to claim 5, wherein said impact cutting means includes two spring-actuated impact cutters in horizontal and parallel alignment, each cutter having an axis and a free end, and said horizontally positioned cutter blade is attached to the free ends of said two impact cutters substantially perpendicular to the axes thereof.

12. Equipment according to claim 5, wherein said strap removing means comprises a strap pulling device including first and second parallel contacting rollers, each having an elastic cylindrical surface, rotating means for rotating said rollers in opposite directions, and means for forcefully clamping said straps between said rollers such that said straps are pulled off said bale during rotation of said rollers.

13. Equipment according to claim 12, wherein said strap removing means further includes stationary bearing means for holding said first roller, with said first roller being rotationally driven by said rotating means, and pivot means connected at one end of said second roller for permitting movement of said second roller between a first position in parallel contacting alignment with said first roller and a second position pivoted out of contact with said first roller so as to permit insertion of said straps between said first and second rollers.

14. Equipment according to claim 13, wherein said first roller is positioned beneath said second roller.

15. Equipment according to claim 13, wherein said first roller is positioned above said second roller.

16. Equipment according to claim 12, wherein said rotating means includes a motor-driven gear having two output shafts rotatable in opposite directions, each shaft being connected to one of said rollers.

17. Equipment according to claim 12, wherein each of said rollers has a solid cylindrical surface covered with a layer of an elastic material.

* * * * *